US010907388B2

(12) United States Patent
Miller

(10) Patent No.: US 10,907,388 B2
(45) Date of Patent: Feb. 2, 2021

(54) VEHICLE DOOR HANDLE ASSEMBLY

(71) Applicant: Nissan North America, Inc., Franklin, TN (US)

(72) Inventor: Adam Miller, Novi, MI (US)

(73) Assignee: Nissan North America, Inc., Franklin, TN (US)

( * ) Notice: Subject to any disclaimer, the term of this patent is extended or adjusted under 35 U.S.C. 154(b) by 674 days.

(21) Appl. No.: 15/692,607

(22) Filed: Aug. 31, 2017

(65) Prior Publication Data

US 2019/0063121 A1 Feb. 28, 2019

(51) Int. Cl.

| | |
|---|---|
| ***E05B 85/16*** | (2014.01) |
| ***E05B 77/38*** | (2014.01) |
| ***E05B 79/06*** | (2014.01) |
| ***E05B 77/34*** | (2014.01) |

(52) U.S. Cl.

CPC ..... *E05B 85/16* (2013.01); *E05B 77/34* (2013.01); *E05B 77/38* (2013.01); *E05B 79/06* (2013.01)

(58) Field of Classification Search

CPC ... Y10T 292/57; Y10T 16/458; Y10T 292/85; E05B 79/06; E05B 77/36; E05B 77/34; E05B 17/0045; E05B 77/38; Y10S 292/56

See application file for complete search history.

(56) References Cited

U.S. PATENT DOCUMENTS

| | | | | |
|---|---|---|---|---|
| 3,837,657 | A | 9/1974 | Farnam et al. | |
| 5,176,016 | A * | 1/1993 | Hill | E05B 79/06 70/417 |
| 7,152,893 | B2 | 12/2006 | Pudney | |
| 7,226,096 | B2 | 6/2007 | Ito et al. | |
| 8,328,250 | B2 | 12/2012 | Botten et al. | |
| 9,322,200 | B1 * | 4/2016 | Shimizu | E05B 79/06 |
| 9,404,293 | B2 * | 8/2016 | Kudoh | E05B 77/38 |

(Continued)

FOREIGN PATENT DOCUMENTS

| | | |
|---|---|---|
| JP | 2010-126950 A | 6/2010 |
| JP | 2011-032818 A | 2/2011 |

OTHER PUBLICATIONS

U.S. Appl. No. 15/692,607; Vehicle Door Handle Assembly; A Miller ; filed Aug. 31, 2017 (Unpublished).

(Continued)

*Primary Examiner* — Mark A Williams
(74) *Attorney, Agent, or Firm* — Global IP Counselors, LLP

(57) ABSTRACT

A vehicle door handle assembly includes a base member, a handle member and a seal member. The base member installs along an interior surface of a vehicle door. The handle member installs along an exterior surface of the vehicle door. The handle member is pivotally connected to the base member for movement between an at rest position and a door opening position. The seal member is attached to the base member with a first surface of the seal member overlaying a portion of the exterior surface of the vehicle door and a second surface opposite the first surface faces a section of the handle member, The first surface has at least one projection extending therefrom engaged with the base member. The second surface has at least one bumper extending therefrom toward the handle member. The at rest position the section of the handle member contacts the at least one bumper.

18 Claims, 8 Drawing Sheets

(56) References Cited

U.S. PATENT DOCUMENTS

| | | | | |
|---|---|---|---|---|
| 10,094,151 | B2 * | 10/2018 | Yoshino | E05B 77/34 |
| 2006/0038417 | A1 * | 2/2006 | Pudney | E05B 13/002 292/336.3 |
| 2007/0182107 | A1 * | 8/2007 | Wesson | E05B 79/06 277/628 |
| 2008/0197582 | A1 * | 8/2008 | Botten | E05B 79/06 277/628 |
| 2010/0187838 | A1 * | 7/2010 | Ieda | B60R 25/00 292/336.3 |
| 2014/0167433 | A1 * | 6/2014 | Gerber | E05B 79/06 296/1.02 |

OTHER PUBLICATIONS

2015 Camry; Door Handle Gasket.
2017 Corolla; Door Handle Gasket.
2017 Prius; Door Handle Gasket.
2016 Prius; Door Handle Gasket.

* cited by examiner

VEHICLE DOOR HANDLE ASSEMBLY

BACKGROUND

Field of the Invention

The present invention generally relates to a vehicle door handle assembly. More specifically, the present invention relates to a vehicle door handle assembly with a seal member having a molded bumper.

Background Information

Vehicle door handle assemblies are typically mounted to a vehicle door providing a mechanical device that allows a passenger to open a closed vehicle door. A handle member of the door handle assembly pivots between an at rest position and a door opening position. When the handle member is released by a passenger, spring biasing moves the handle member from the door opening position back to the at rest position.

SUMMARY

One object of the disclosure is to provide a vehicle door handle assembly with a seal member installed between a handle member and an outer door panel, the seal member providing cushioning to the handle member as is returns to an at rest position from a door opening position.

In view of the state of the known technology, one aspect of the present disclosure is to provide a vehicle door handle assembly with a base member, a handle member and a seal member. The base member is configured to install along an interior surface of a vehicle door. The handle member is configured to install along an exterior surface of the vehicle door, the handle member further being pivotally connected to the base member for movement between an at rest position and a door opening position. The seal member is attached to the vehicle door such that a first surface of the seal member overlays a portion of the exterior surface of the vehicle door and a second surface opposite the first surface faces a section of the handle member. The first surface has at least one projection extending therefrom engaged with the base member. The second surface has at least one bumper extending therefrom toward the handle member such that in the at rest position the section of the handle member contacts the at least one bumper.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
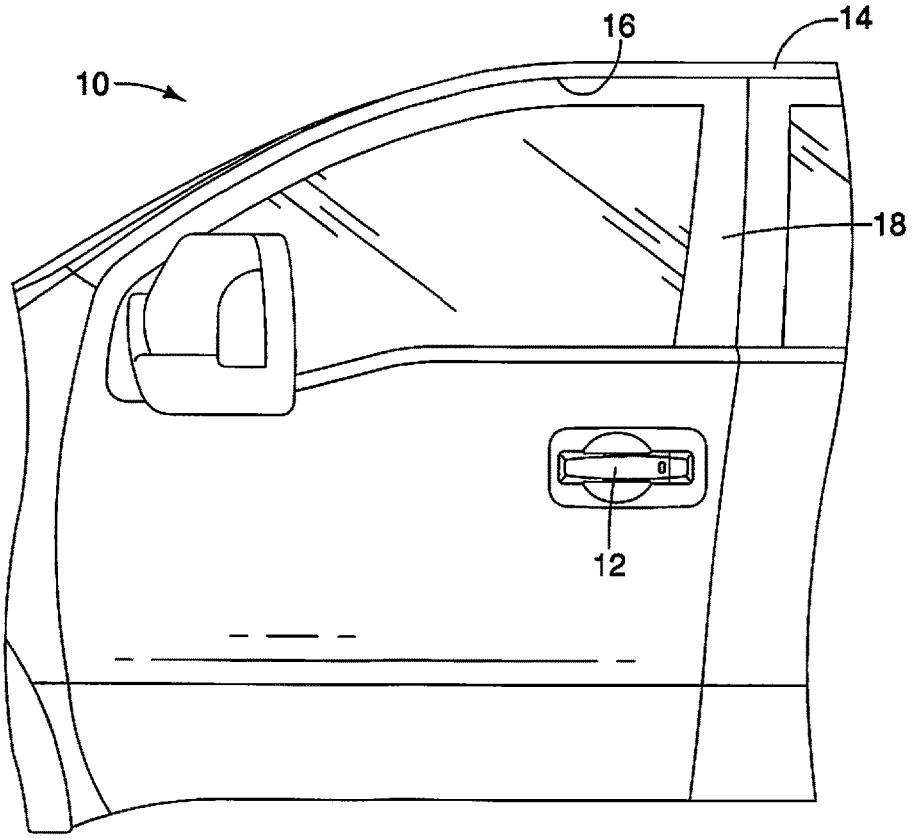
FIG. 1 is a side view of a vehicle that includes a door with a door handle assembly in accordance with a first embodiment.

Referring initially to FIG. 1, a vehicle 10 having a door handle assembly 12 is illustrated in accordance with a first embodiment.

The vehicle 10 includes, among other features, a vehicle body structure 14 that defines a door opening 16 and a door 18. The door 18 is mounted to the vehicle body structure 14 for pivotal movement via hinges (not shown) in a conventional manner. The door 18 is movable between a closed orientation shown in FIG. 1 and an open orientation (not shown). The door 18 includes a latch mechanism (not shown) that retains the door 18 in the closed orientation. The door handle assembly 12 is connected via, for example, a cable C (FIG. 4) that operates the latch mechanism (not shown) such that the latch mechanism allows the door 18 to be released from the closed orientation and moved manually to the open orientation. Since door, hinge structures and latch mechanism of a vehicle are conventional structures, further description is omitted for the sake of brevity.

Figure 2:
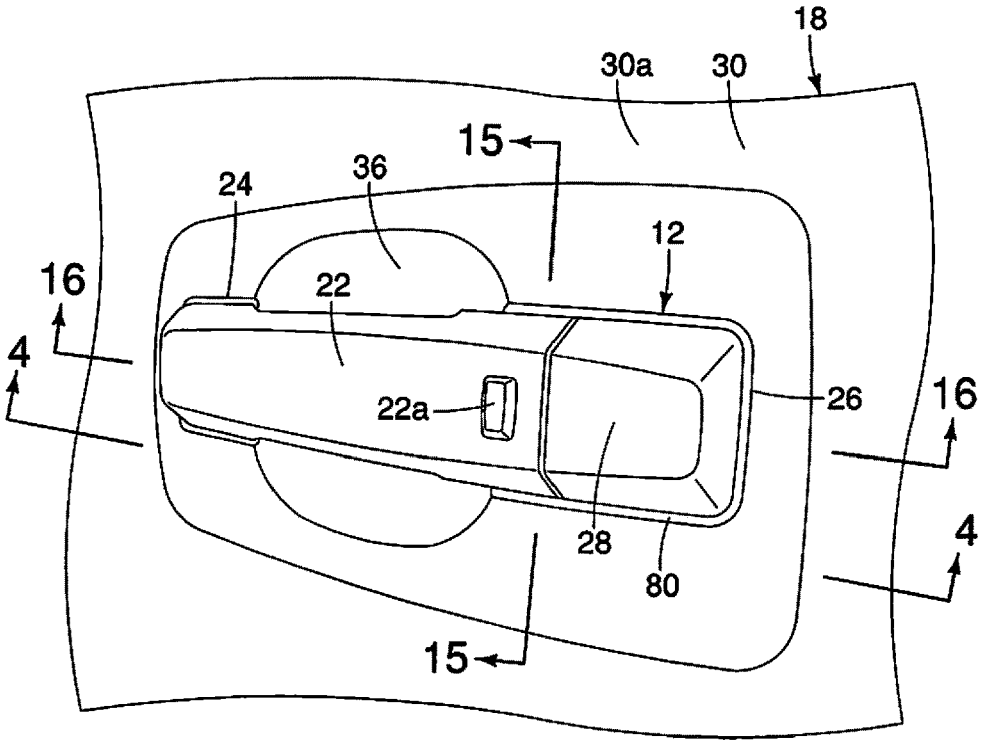
FIG. 2 is perspective view of a portion of the door showing the door handle in an at rest position in accordance with the first embodiment.
Figure 3:
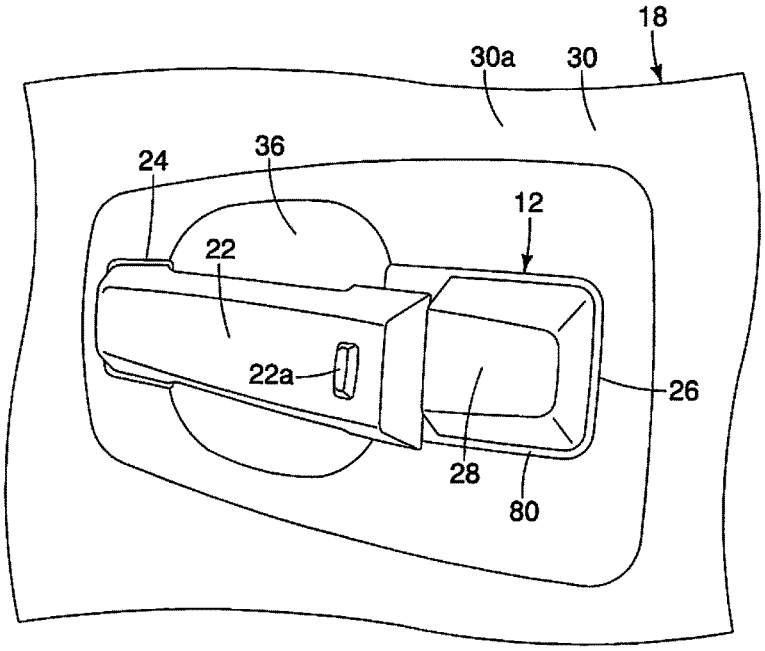
FIG. 3 is another perspective view similar to FIG. 2 of a portion of the door showing the door handle in a door opening position in accordance with the first embodiment.
Figure 4:
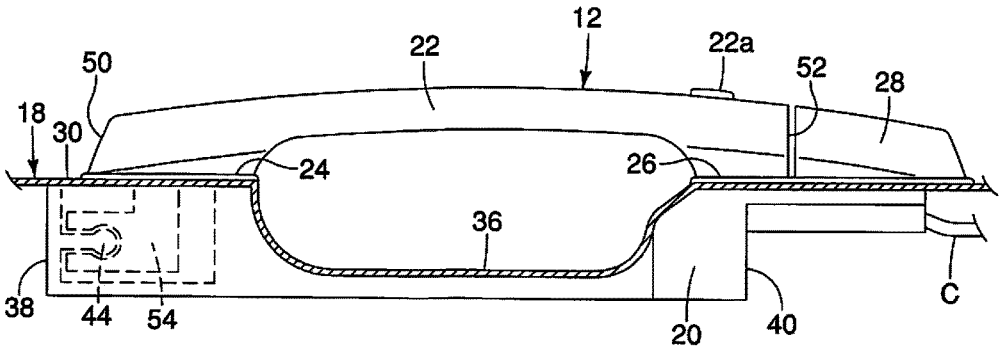
FIG. 4 is a cross-sectional view of the door handle assembly taken along the line 4-4 in FIG. 2, in accordance with the first embodiment.

As shown in FIGS. 2, 3 and 4, the door handle assembly 12 (also referred to as a vehicle door handle assembly) is installed to the door 18. FIG. 2 shows the door handle assembly 12 in an at rest position such that if the door 18 is closed, the latch mechanism retains the door 18 in the closed orientation. FIG. 3 shows the door handle assembly 12 moved to a release position or door opening position such that the cable C releases the latch mechanism (not shown) allowing the door 18 to move to the open orientation in a conventional manner.

Figure 5:
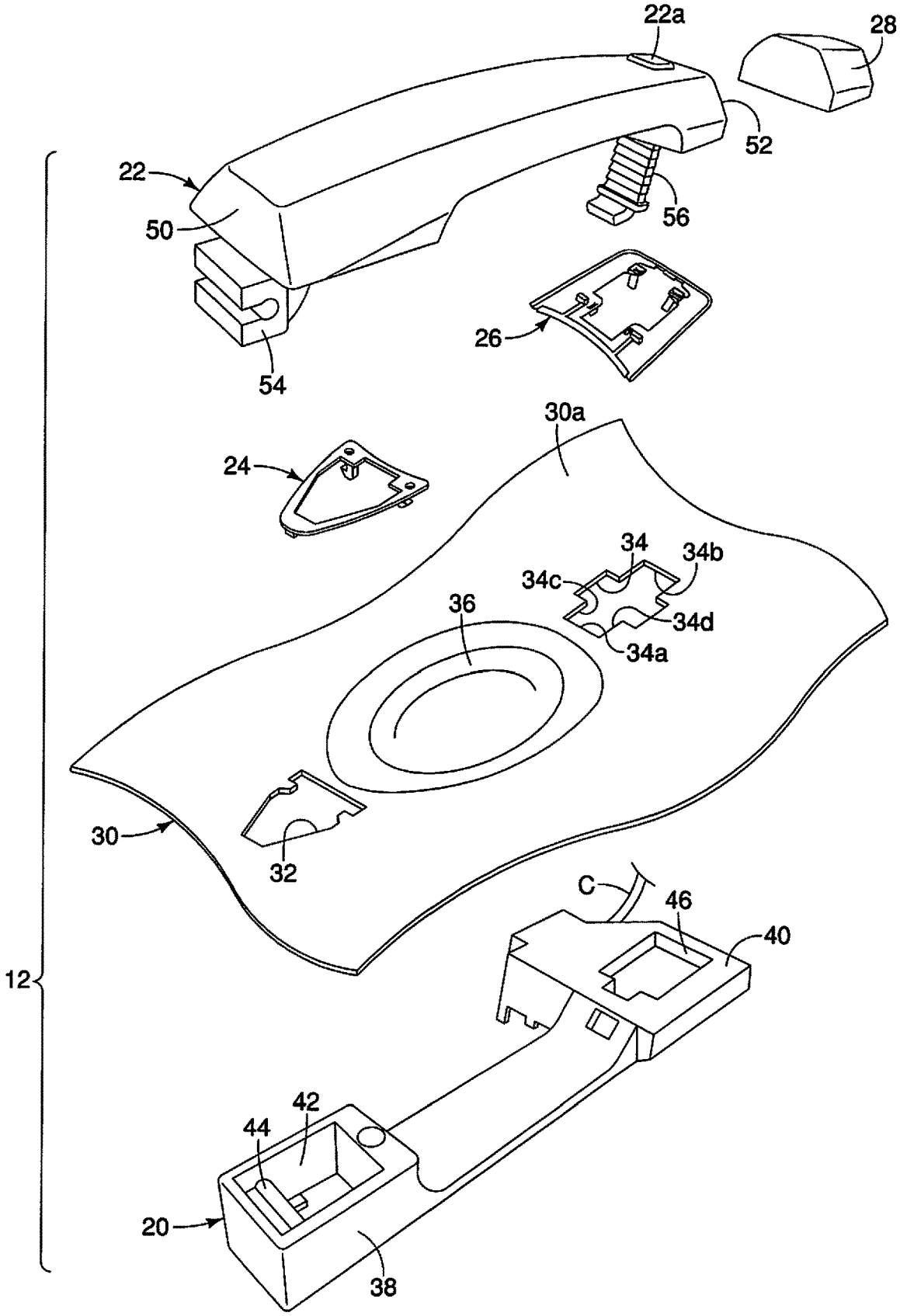
FIG. 5 is an exploded view of the door handle assembly showing a base member, an outer door panel, a handle member and a seal member in accordance with the first embodiment.

As shown in FIGS. 4 and 5, the door handle assembly 12 basically includes a base member 20, a handle member 22, a front seal 24, a seal member 26 and a lock member 28. A description of the door handle assembly 23 and attachment of the door handle assembly 12 to an outer door panel 30 of the door 18 provided below following a description of the outer door panel 30.

As shown in FIGS. 4 and 5, the outer door panel 30 of the door 18 includes an exterior surface 30*a*, an interior surface 30*b*, a first opening 32 and a second opening 34. The exterior surface 30*a* is formed with a concaved area 36 located between the first opening 32 and the second opening 34. The concaved area 36 is dimensioned to receive a vehicle passengers hand, such that the vehicle passenger can inert their hand between the handle member 22 and the outer door panel 30 in order to open the door 18. The first opening 32 and the second opening 34 both extend through the outer door panel 30 from the exterior surface 30*a* to the interior surface 30*b*.

The base member 20 includes a first end 38 and a second end 40. The first end 38 includes a recessed area 42 with a pivot projection 44 formed therein. The second end 40 includes an opening 46, one end of the cable C and a cable movement mechanism (not shown). Since cable movement mechanisms are conventional features further description is omitted for the sake of brevity.

The base member 20 is configured to install along the interior surface 30*b* of a door 18 such that the recessed area 42 aligns with the first opening 32 in the outer door panel 30, and the opening 46 aligns with the second opening 34 in the outer door panel 30. The base member 20 attaches to the interior surface 30*b* of the outer door panel 30 of the door 18 in a conventional manner via, for example, mechanical fasteners (not shown), such as threaded fasteners and/or snap-fitting projections.

The handle member 22 has a first end 50 and a second end 52. The first end 50 has a U-shaped portion 54 that is dimensioned to pivot about the pivot projection 44 of the base member 20, when installed to the base member 20. The second end 52 includes a L-shaped hook member 56 that serves to limit movement of the handle member 22 when the handle member 22 is moved between the at rest position (FIG. 2) and the door opening position (FIG. 3). The L-shaped hook member 56 is also configured to interact with the cable movement mechanism (not shown) within the base member 20, thereby moving the cable C to latch and unlatch the door 18, in a conventional manner.

The handle member 22 is not installed to the outer door panel 30, but rather, the U-shaped portion 54 is inserted through the first opening 32 and into the recessed area 42 of the base member 20. Further, the U-shaped portion 54 is fitted on to the pivot projection 44 such that the handle member 22 can undergo pivoting movement about the pivot projection 44 in a conventional manner. Further, the L-shaped hook member 56 is inserted through the second opening 34 and into the opening 46 of the base member 20. As is shown in the drawings, the front seal 24 is located between the front end 50 of the handle member 22 and the exterior surface 30*a* of the outer door panel 30 and encircling the first opening 32. As described further below, the seal member 26 is installed to the outer door panel 30 and to the base member 20 such that the seal member 26 aligns with the second opening 34 of the outer door panel 30.

Hence, the handle member 22 is configured to install along the exterior surface 30*a* of the door 18 and is pivotally connected to the base member 20 for movement between the at rest position (FIG. 2) and the door opening position (FIG. 3). Further, the handle member 22 is spring biased to move to the at rest position by a biasing spring (not shown) that is concealed within the door handle assembly 12 in a conventional manner.

The front seal 24 provides several design features to the door 18 such as improving the appearance of the door 18. The front seal 24 further serves as both a seal and an escutcheon that provides sealing and protection between the handle member 22 and the first opening 32.

The lock member 28 can be a mechanical locking mechanism that receives a key (not shown) such that a vehicle operator can lock and unlock the door 18 in a conventional manner. Alternatively, as shown in the depicted embodiment, the handle member 22 can be connected to an electronic lock system (not shown) that is locked an locked by contacting a button 22*a* on the handle member 22 in a conventional manner. Hence, in the depicted embodiment, the lock member 28 is merely a dummy element that is fitted to the door 18 and the door handle assembly 12 for appearance only.

A description of the seal member 26 is now provided with specific reference to FIGS. 6-14.

Like the front seal 24, the seal member 26 also provides several design features to the door handle assembly 12 such as improving the appearance of the door 18, and serves as both a seal and an escutcheon that provides sealing and protection between the handle member 22 and the second opening 34.

Figure 14:
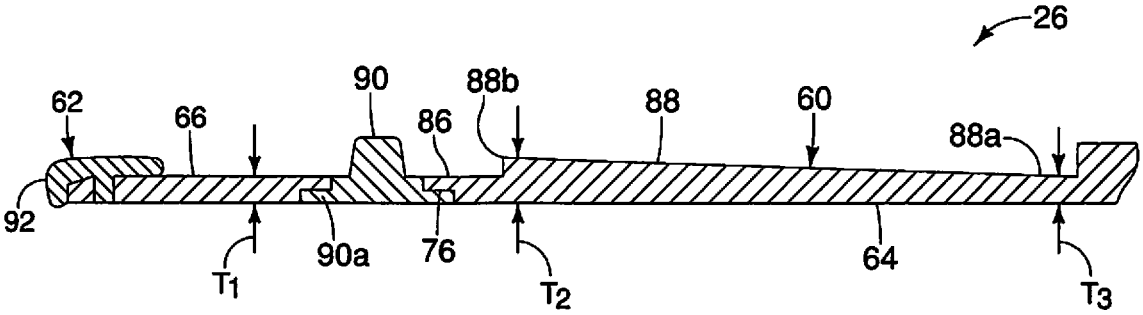
FIG. 14 is another cross-sectional view of a portion of the main body and molded portion taken along the line 14-14 in FIG. 9, showing details of the surfaces of the main body and the molded portion in accordance with the first embodiment.

The seal member 26 is attached to one or both of the base member 20 and the outer door panel 30. In the depicted embodiment, as shown in FIG. 14, the seal member 26 is directly attached to the outer door panel 30, as described in greater detail below.

The seal member 26 basically includes a main body 60 and a molded portion 62. In the depicted embodiment, the main body 60 is manufactured first via, for example, injection molding. Thereafter, the molded portion 62 is formed on and around specific portions and surfaces of the main body 60.

The main body 60 is molded from a first material and the molded portion 62 is made of a second material that is more flexible and more compressible than the first polymer material. Specifically, the main body 60 of the seal member 26 is formed of a plastic, polymer or elastomer material such as, for example, polypropylene or polyethylene. The main body 60 is formulated such that it has a greater degree of rigidity (more rigid) than the molded portion 62. The molded portion 62 is formed to remain fixed to the main body 60. The molded portion 62 can also be formed a plastic, polymer or elastomer material such as, for example, polypropylene or polyethylene, but is preferably formulated to be more flexible and more resilient and compressible than the main body 60.

The main body 60 of the seal member 26 has a first surface 64 (an inboard surface) and a second surface 66 (an outboard surface). The first surface 64 of the seal member 26 faces inboard and overlays a portion of the exterior surface 30*a* of the outer door panel 30 of the door 18. The second surface 66 is opposite the first surface 62 faces outboard and further faces a section of the second end 52 of the handle member 22.

Figure 7:
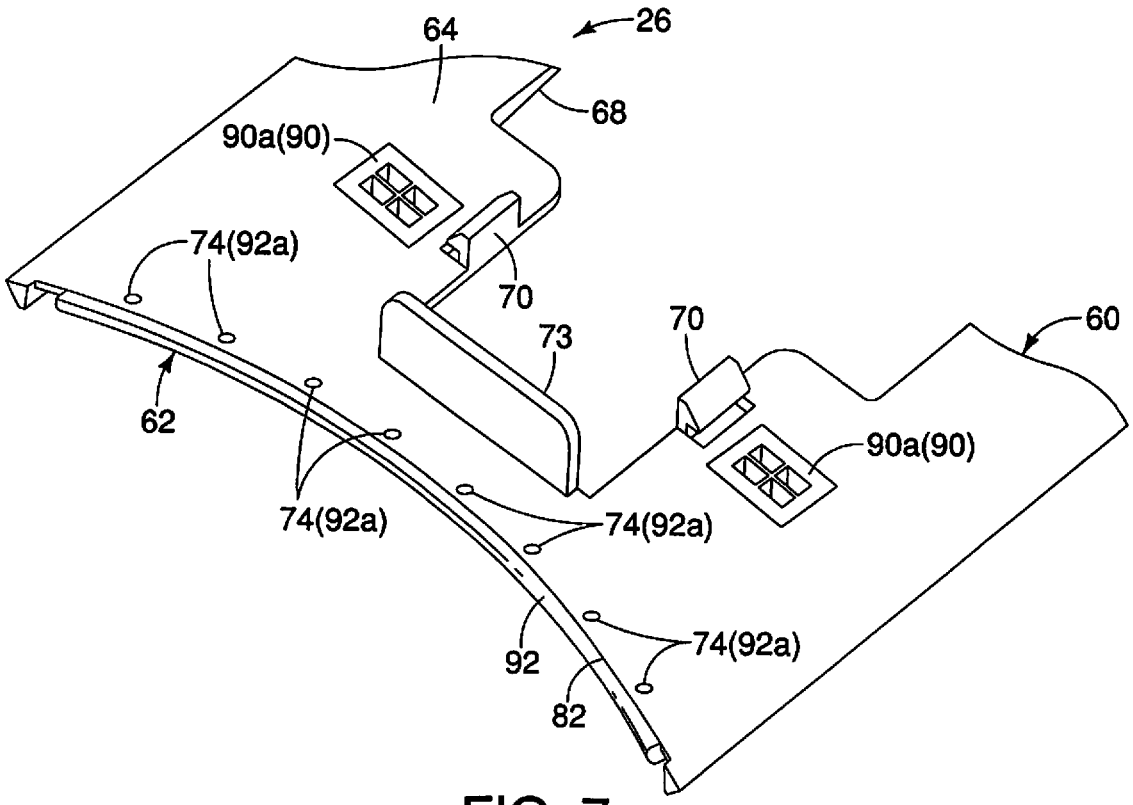
FIG. 7 is a perspective view of an inboard surface of the seal member showing details of the main body in accordance with the first embodiment.

As shown in FIG. 7, the main body 60 further includes an opening 68 that extends from the first surface 64 to the second surface 66. The main body 60 also includes a pair of first projections 70, a pair of second projections 72 and a third projection 73 that all extend from the first surface 64 in a direction away from the second surface 66. The opening 68 is dimensioned to receive and allow movement of the L-shaped hook member 56 of the handle member 22, and receive a lock/key cylinder of the lock member 28, if the lock member 28 includes such a lock/key cylinder.

Figure 8:
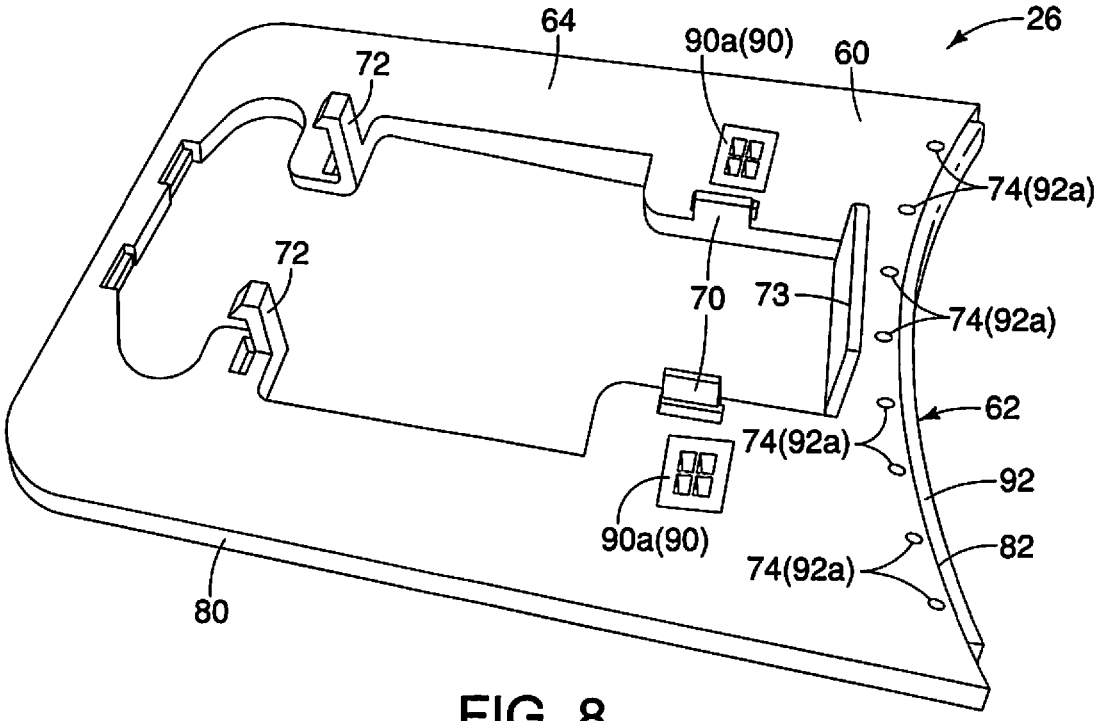
FIG. 8 is another perspective view of the inboard surface of the seal member showing a plurality of projections and openings that receive elements of the molded portion in accordance with the first embodiment.
Figure 15:
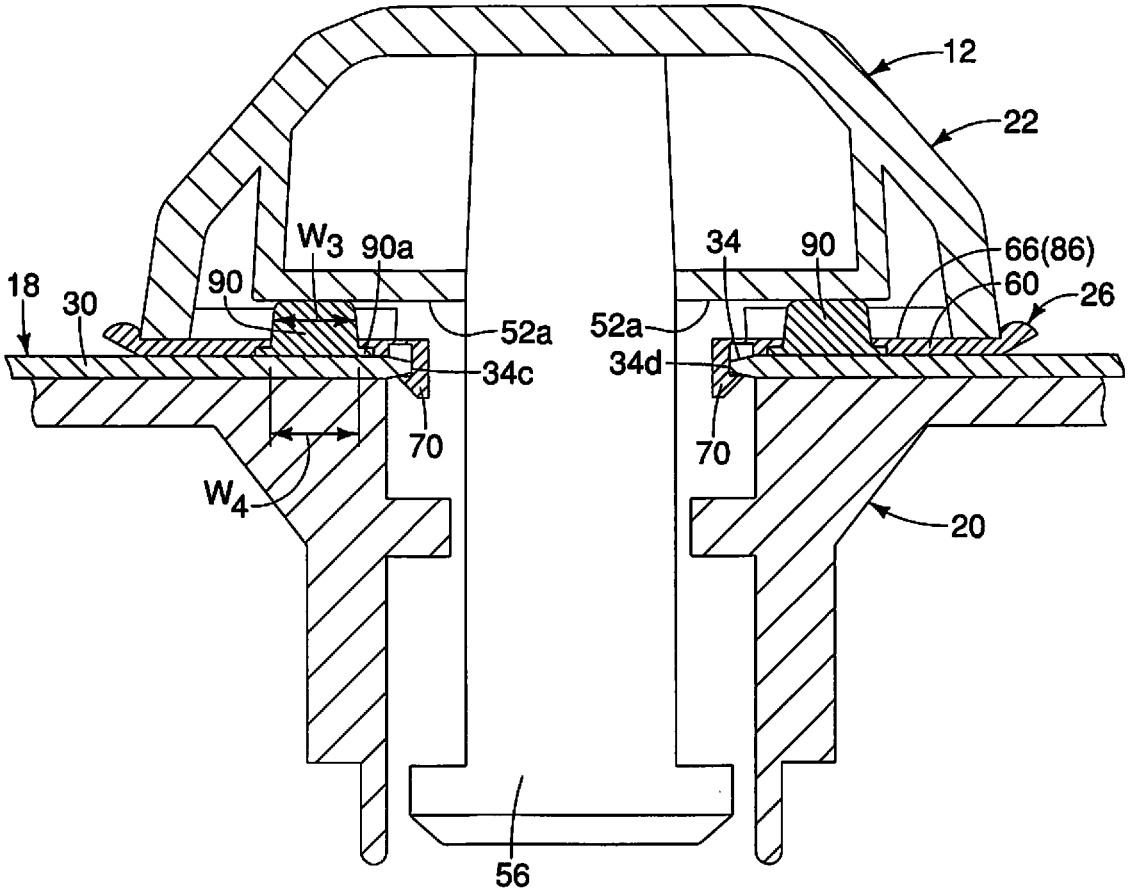
FIG. 15 is a cross-sectional view of the door handle assembly taken along the line 15-15 in FIG. 2, showing details the handle member, the seal member and the base member in accordance with the first embodiment.

The first projections 70 and the second projections 72 extend from the first surface 64 of the main body 60 in an inboard direction with the seal member 26 installed to the door 18. As is also shown in FIGS. 7 and 8, the main body 60 of the seal member 26 has plurality of openings 74 (small openings) that extend from the first surface 64 to the second surface 66. As shown in FIGS. 14 and 15, the main body 60 also includes openings 76. As described further below, the openings 74 and 76 are for securing the molded portion 62 to the main body 60.

The first projections 70 extend in an inboard direction from the first surface 64 of the main body 60 such that the first projections 70 extend into the second opening 34 of the outer door panel 30 and engage or snap-fit to the outer door panel 30 securing the seal member 26 to the outer door panel 30, and, hence to the base member 20. More specifically, the first projections 70 contact and engage the lower and upper edges 34*c* and 34*d* (see FIG. 5) of the second opening 34 of the outer door panel 30. As indicated in FIG. 5, the second projections 72 similarly extend through the second opening 34 engaging the outer door panel 30 attaching (snap fitting) the seal member 26 to the outer door panel 30 and the base member 20. The second projections 72 contact and engage the rearward edge 34*b* of the second opening 34 of the outer door panel 30.

The third projection 73 contacts the front edge 34*a* of the second opening 34 and therefore restricts forward movement of the seal member 26. The second projections 72 restrict rearward movement of the seal member 26 when installed to the outer door panel 30 and the first projections 70 restrict upward and downward movement of the seal member 26 relative to the door 18.

Figure 6:
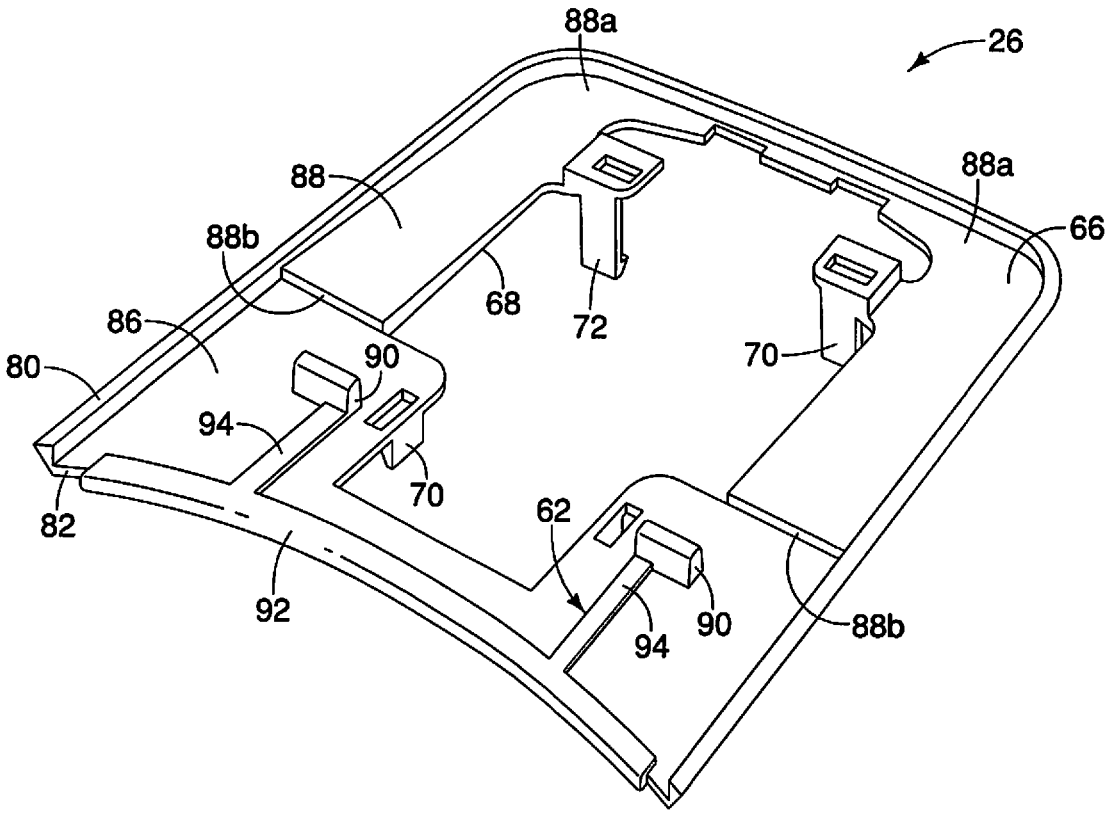
FIG. 6 is a perspective view of an outboard surface of the seal member showing details of a main body and a molded portion in accordance with the first embodiment.
Figure 9:
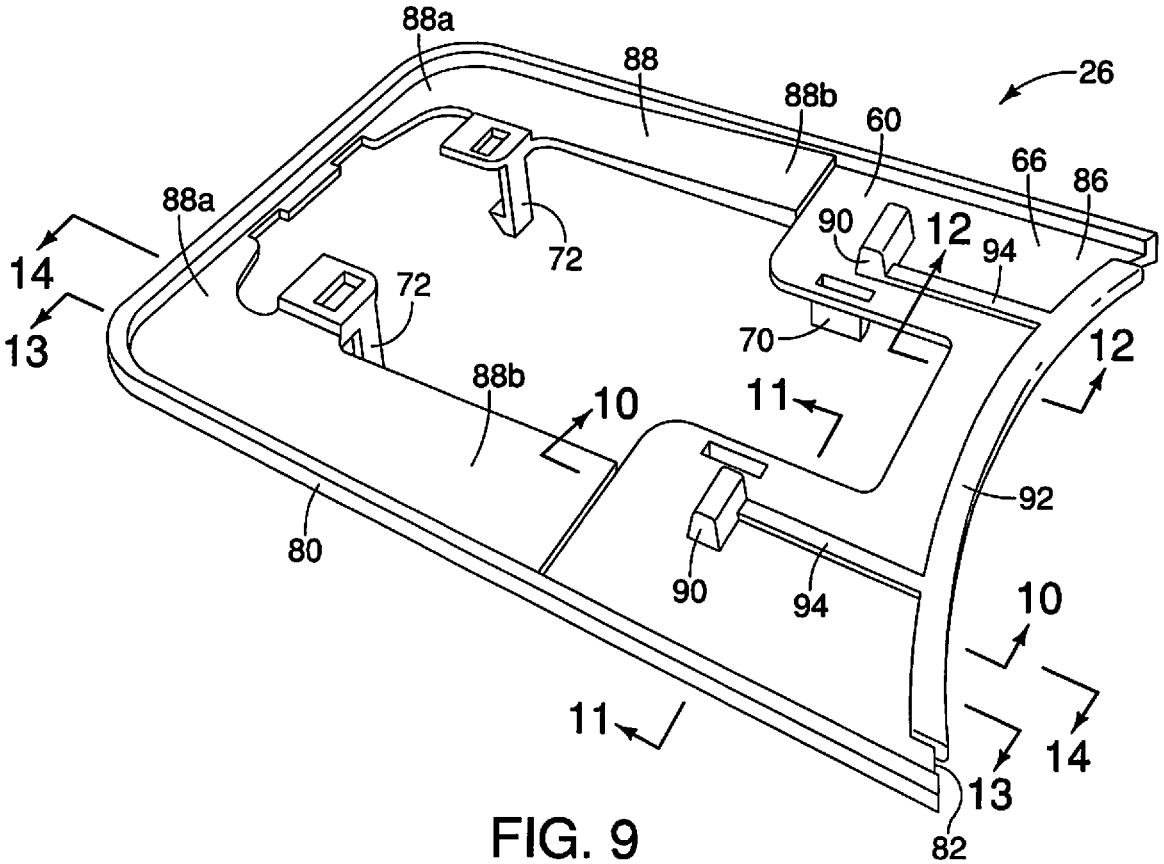
FIG. 9 is another perspective view of the outboard surface of the seal member showing details of the main body and the molded portion including bumpers and an air dam in accordance with the first embodiment.

The main body 60 further includes an outer peripheral lip 80 that extends from the second surface 66 in a direction (an outboard direction) away from the first surface 64. As shown in FIGS. 6, and 9, the outer peripheral lip 80 extends around three sides of the main body 60. With the handle member 22 in the at rest position, as shown in FIG. 2, the outer peripheral lip 80 extends along two edges of the handle member 22 (upper and lower edges thereof). A forward edge 82 of the main body 60 has a curved or arcuate shape, as shown in FIGS. 6-9. The openings 74 (plurality of openings 74) are located adjacent to and along the forward edge 82 of the main body 60.

Figure 13:
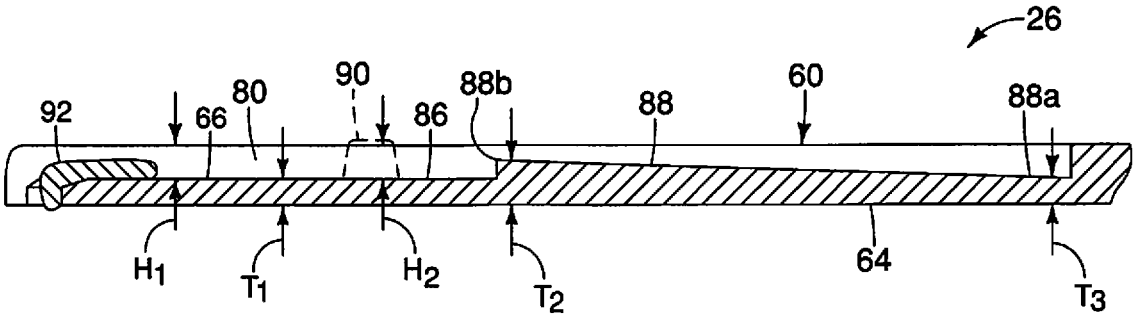
FIG. 13 is another cross-sectional view of a portion of the main body and molded portion taken along the line 13-13 in FIG. 9, showing details of surfaces of the main body in accordance with the first embodiment.

As shown in FIGS. 9, 13 and 14, the second surface 66 of the main body 60 includes a first surface area 86 and a second surface area 88. As shown in FIGS. 13 and 14, the second surface area 88 is inclined relative to the first surface area 86. More specifically, the second surface area 88 has a first end 88*a* and a second end 88*b*, with the second end 88*b* being adjacent to the first surface area 86. The second end 88*b* includes and offset or stepped portion such that, as viewed in cross-section in FIGS. 13 and 14, at the second end 88*b*, the second surface area 88 is higher and therefore offset from the first surface area 86.

The main body 60 has a first thickness $T_1$ at the first surface area 86. The main body 60 has a second thickness $T_2$ along the second end 88*b* of the second surface area 88 adjacent to the first surface area 86. The second surface area 88 tapers down with the main body 60 having a decreasing thickness such that the main body 60 has a third thickness $T_3$ at the first end 88*a* of the second surface area 88. As shown in FIGS. 13 and 14, the second thickness $T_2$ is greater than the third thickness $T_3$, and the third thickness $T_3$ is greater than the first thickness $T_1$. The outer peripheral lip 80 extends from the second surface 66 in a direction away from the first surface 64. Further, except for the area of the second surface area 88 adjacent to the first surface area 86, the outer peripheral lip 80 surrounds the second surface area 88 and extends along opposite sides of the first surface area 86 to the forward edge 82.

Figure 16:
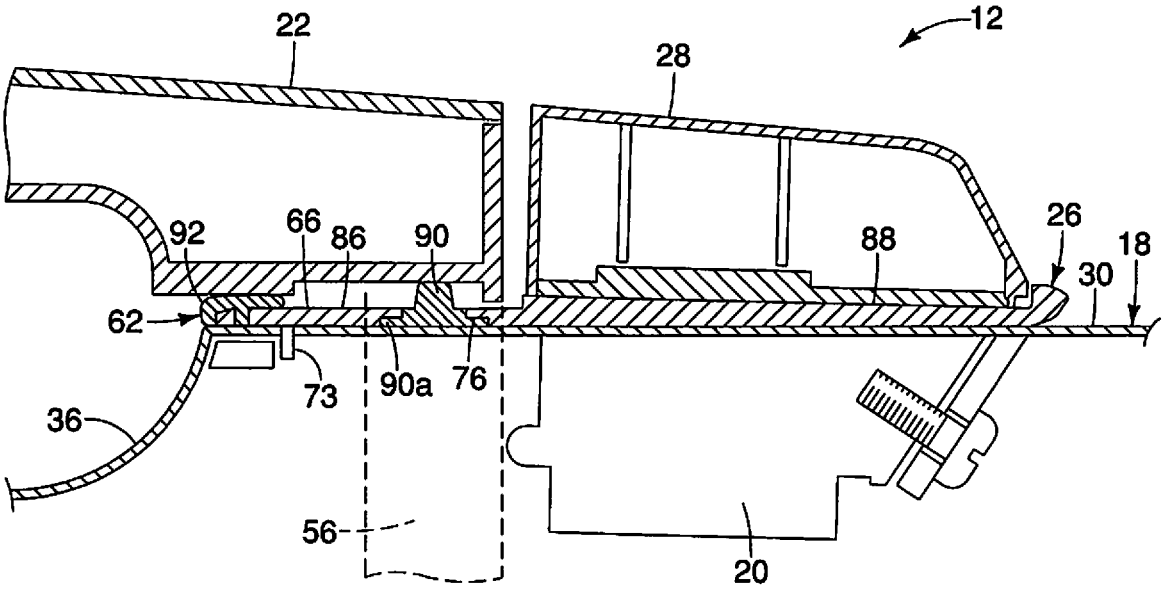
FIG. 16 is another cross-sectional view of a portion of the door handle assembly taken along the line 16-16 in FIG. 2, showing details the handle member, the seal member and the base member in accordance with the first embodiment.

As shown in FIG. 16, the second surface area 88 of the main body 60 is dimensioned and positioned on the outer door panel 30 to receive the lock member 28. The first surface area 88 of the main body 60 is dimensioned and positioned on the outer door panel 30 to receive the second end 52 of the handle member 22 with the handle member 22 is the at rest position.

A description of the molded portion 62 is now provided with specific reference to FIGS. 6-14. The molded portion 62 includes two bumpers 90 (also referred to as projections), an air dam 92 and connections portion 94. The molded portion 62 primarily extends along the first surface area 86 of the second surface 66 of the main body 60. However, a small portion of the air dam 92 wraps around the forward edge 82 of the main body 62.

As shown in FIG. 15, each of the two bumpers 90 of the molded portion 62 includes a molded base 90*a*. As shown in FIGS. 14 and 15, the lower section of the molded base 90*a* is larger than an upper section thereof using an over molded construct. The molded base 90*a* is formed within the opening 76 of the main body 60 of the seal member 26, conforms to the overall shape of the opening 76, thereby retaining the bumper 90 in place relative to the main body 60 of the seal member 26. The remainder of the bumper 90 extends outward away from the first surface area 86 of the second surface 66. As shown in FIG. 13, the outer peripheral lip 80 has a first height $H_1$, as measured from the first surface area 86 of the second surface 66. The bumper 90 has a second height H2 that is greater than the first height $H_1$. Therefore, the bumper 90 extends beyond the outer peripheral lip 80 of the main body 60. As shown in FIG. 15 with the handle member 22 in the at rest position, the bumper 90 contacts a surface 52*a* of the second end 52 of the handle member 22. Since the molded portion 62 (and the bumpers 90) are made of a resilient and compressible material, the bumpers 90 are provided dampening and/or cushioning to the handle member 22 as the handle member 22 is moved from the door opening position to the at rest position. The bumpers 90 further dampen noise and vibration when the handle member 22 is moved from the door opening position to the at rest position.

Figure 10:
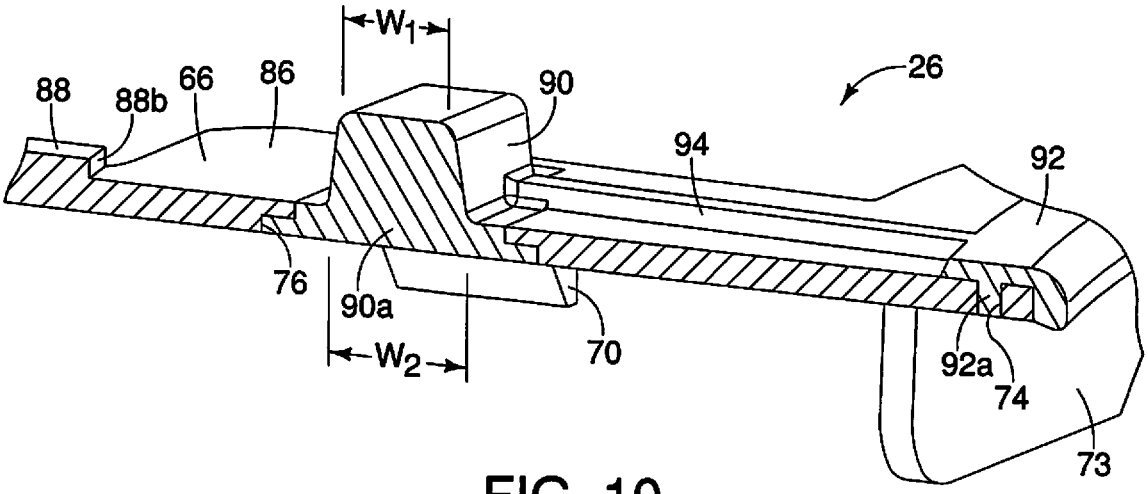
FIG. 10 is a cross-sectional view of a portion of the main body and molded portion taken along the line 10-10 in FIG. 9, showing details of one of the bumpers and the air dam in accordance with the first embodiment.

Each of the bumpers 90 is shaped such that a distal end surface (that contacts the surface 52*a* of the handle member 22) of the bumper 90 is smaller than the base 90*a* of the bumper 90. Specifically, as shown in FIG. 10, as measured in a lengthwise direction of the main body 60, the distal end of the bumper 90 has a width $W_1$ and the base 90*a* has a width $W_2$ that is greater than the width $W_1$. Similarly, as shown in FIG. 15 as measured in a widthwise direction of the main body 60, the distal end of the bumper 90 has a width $W_3$ and the base 90*a* has a width $W_4$ that is greater than the width $W_3$. Hence, the bumper 90 tapers in size moving from the base 90*a* to the distal end of the bumper 90.

Figure 12:
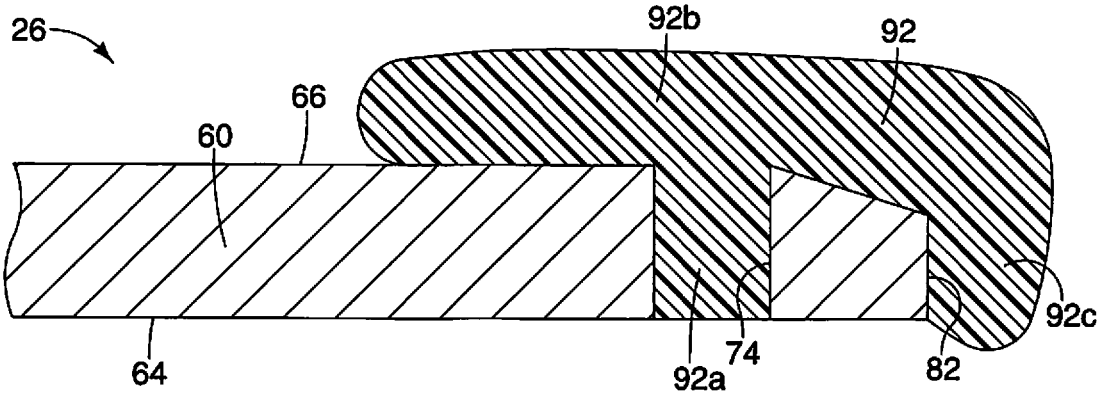
FIG. 12 is another cross-sectional view of a portion of the main body and molded portion taken along the line 12-12 in FIG. 9, showing details of the air dam of the molded portion in accordance with the first embodiment.

The air dam 92 is formed along the arcuate shaped forward edge 82 of the main body 60 of the seal member. As shown in FIG. 12, the air dam 92 includes a plurality of molded bases 92*a*, an upper portion 92*b* and a forward or lower portion 92*c*.

The molded bases 92*a* are formed within respective ones of the openings 74 of the main body 60, thereby retaining the air dam 92 and the molded portion 62 to the main body 60. In the depicted embodiment, the molded bases 92*a* are cylindrically shaped. However, like the molded bases 90*a* of the bumpers 90, the molded bases 92*a* can be formed with over molded bottom section (not shown). The upper portion 92*b* has an arcuate shape conforming to the shape of the forward edge 82 of the main body 60. The upper portion 92*b* extends along the first surface area 86 of the second surface 66 of the main body 60 adjacent to the forward edge 82. The forward or lower portion 92*c* of the molded portion 62 extends downward (relative to the depiction in FIG. 12) from the upper portion 92*b*, and covers a majority of the forward edge 82 of the main body 60, as shown in FIGS. 5-9. With the seal member 26 installed to the outer door panel 30 of the door 18, the air dam 92 reduces and/or eliminates air noises detected within the vehicle 10 when the vehicle 10 is in motion.

Figure 11:
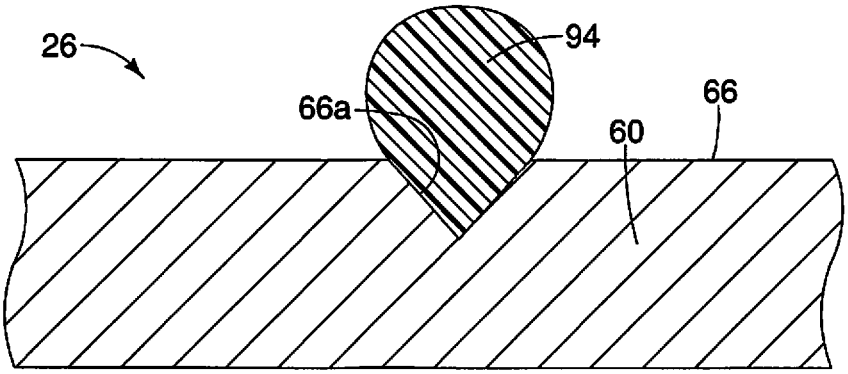
FIG. 11 is another cross-sectional view of a portion of the main body and molded portion taken along the line 11-11 in FIG. 9, showing details of a connecting portion of the molded portion in accordance with the first embodiment.

The connection portion 94 is molded with the bumpers 90 and the air dam 92 and is provided to ensure even distribution of the raw material used to mold the molded portion 62 during the molding process. As shown in FIG. 11, a portion of the connection portion 94 can be disposed within a groove or recess 66*a* formed in the first surface area 86 of the second surface 66 of the main body 60 between each of the bumpers 90 and the air dam 92. As shown in FIG. 16, the air dam 92 is at least partially covered and is concealed by the handle member 22 with the handle member 22 in the at rest position.

The vehicle and door structures (other than the door handle assembly 12 and the seal member 26) are conventional components that are well known in the art. Since these structures are well known in the art, these structures will not be discussed or illustrated in detail herein. Rather, it will be apparent to those skilled in the art from this disclosure that the components can be any type of structure and/or programming that can be used to carry out the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), the following directional terms "forward", "rearward", "above", "downward", "vertical", "horizontal", "below" and "transverse" as well as any other similar directional terms refer to those directions of a vehicle equipped with the vehicle door handle assembly. Accordingly, these terms, as utilized to describe the present invention should be interpreted relative to a vehicle equipped with the vehicle door handle assembly.

The term "configured" as used herein to describe a component, section or part of a device includes hardware that is constructed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired.

Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A vehicle door handle assembly, comprising:

a base member configured to install along an interior surface of a vehicle door;

a handle member configured to install along an exterior surface of the vehicle door, the handle member further being pivotally connected to the base member for movement between an at rest position and a door opening position; and a seal member including a main body and a molded portion fixed to the main body, the main body having a first surface, a second surface opposite the first surface and at least one projections extending from the first surface, the first surface of the seal member being configured to overlay a portion of the exterior surface of the vehicle door with the second surface facing a section of the handle member, the at least one projection being shaped and configured to extend from the first surface through an opening in the vehicle door and attach to the base member, at least a portion of the molded portion extending along the second surface and having at least one bumper extending therefrom toward the handle member such that in the at rest position the section of the handle member contacts the at least one bumper, the main body being formed of a first material and the molded portion being made of a second material that is more flexible and more compressible that the first material.

2. The vehicle door handle assembly according to claim 1, wherein the main body includes a plurality of openings along one edge thereof, the molded portion being formed to the main body such that sections of the molded portion extend through the plurality of openings in main body.

3. The vehicle door handle assembly according to claim 1, wherein the molded portion includes an air dam that extends from the second surface in a direction away from the second surface of the main body.

4. The vehicle door handle assembly according to claim 1, wherein the main body of the seal member includes an outer peripheral lip that extends from the second surface in a direction away from the first surface such that the outer peripheral lip extends along two surfaces of the handle member with the handle member in the at rest position.

5. The vehicle door handle assembly according to claim 1, wherein the at least one bumper is made of a resilient and compressible material that dampens noise and vibration when the handle member is moved from the door opening position to the at rest position.

6. The vehicle door handle assembly according to claim 1, wherein the second surface of the main body includes a first surface area and a second surface area, the molded portion extending along the first surface area, the second surface area being inclined relative to the first surface area such that the main body has a first thickness along a first end of the second surface area and the main body has a second thickness along a second end of the second surface area, the second end of the second surface area being adjacent to the first surface area.

7. The vehicle door handle assembly according to claim 6, wherein the main body of the seal member includes an outer peripheral lip that extends from the second surface in a direction away from the first surface such that the outer peripheral lip surrounds the second surface area and extends along opposite sides of the first surface area.

8. The vehicle door handle assembly according to claim 7, wherein the outer peripheral lip further extends along two surfaces of the handle member with the handle member in the at rest position.

9. The vehicle door handle assembly according to claim 1, wherein the seal member includes an outer peripheral lip that extends from the second surface in a direction away from the first surface such that the outer peripheral lip extends along two surfaces of the handle member with the handle member in the at rest position.

10. The vehicle door handle assembly according to claim 1, wherein the seal member includes an air dam that extends from the second surface in a direction away from the second surface of the main body.

11. The vehicle door handle assembly according to claim 10, wherein the air dam is covered by the handle member with the handle member in the at rest position.

12. The vehicle door handle assembly according to claim 1, wherein the handle member is spring biased to the at rest position.

13. The vehicle door handle assembly according to claim 12, wherein the at least one bumper is made of a resilient and compressible material that dampens noise and vibration when the handle member is moved from the door opening position to the at rest position.

14. The vehicle door handle assembly according to claim 12, wherein the at least one bumper includes a first bumper and a second bumper spaced apart from the first bumper.

15. A vehicle door handle assembly, comprising:

a base member configured to install along an interior surface of a vehicle door;

a handle member configured to install along an exterior surface of the vehicle door, the handle member further being pivotally connected to the base member for movement between an at rest position and a door opening position; and a seal member having a main body that includes a pair of snap-fitting projections proximate a first end of the main body, the pair of snap-fitting projections being configured and dimensioned to extend through an opening in the vehicle door and attach to the base member with the first surface of the seal member overlaying a portion of the exterior surface of the vehicle door, and the second surface having at least one bumper extending therefrom, the at least one bumper being located proximate a second end of the main body and being spaced apart from the pair of snap-fitting projections such that in the at rest position the section of the handle member contacts the at least one bumper wherein the seal member includes a molded portion fixed to the main body with the at least one bumper being part of the molded portion, where the main body is molded from a first material and the molded portion is made of a second material that is more flexible and more compressible than the first material inserted.

16. The vehicle door handle assembly according to claim 15, wherein the main body of the seal member further includes another pair of snap-fitting projections proximate the second end of the main body, the another pair of snap-fitting projections being configured and dimensioned to extend through the opening in the vehicle door and attach to the base member, the another pair of snap-fitting projections being spaced apart from the pair of snap-fitting projections and spaced apart from the at least one bumper.

17. The vehicle door handle assembly according to claim 15, wherein the main body of the seal member further includes another pair of snap-fitting projections proximate the second end of the main body, the another pair of snap-fitting projections being configured and dimensioned to extend through the opening in the vehicle door and attach to the base member, the another pair of snap-fitting projections being spaced apart from the pair of snap-fitting projections and spaced apart from the at least one bumper.

18. The vehicle door handle assembly according to claim 15, wherein the main body of the seal member further includes a flat projection proximate the second end of the main body and extending from the first surface of the main body parallel with the pair of snap-fitting projections and perpendicular to the main body.

* * * * *